US005224793A

United States Patent [19]

De Pol et al.

[11] Patent Number: 5,224,793

[45] Date of Patent: Jul. 6, 1993

[54] SCREEDING APPARATUS

[76] Inventors: Andre De Pol, 26 Firenza Dr., Weston, Ontario, Canada, M9L 1A5; Roberto Martinello, 42 Stavely Cres., Rexdale, Ontario, Canada, M9W 2C4

[21] Appl. No.: 729,208

[22] Filed: Jul. 12, 1991

[30] Foreign Application Priority Data

Jul. 13, 1990 [GB] United Kingdom ..... 9015505

[51] Int. Cl.[5] ..... E01C 19/38; E01C 19/22

[52] U.S. Cl. ..... 404/119; 404/120; 404/114

[58] Field of Search ..... 404/96, 118-120, 404/112, 83, 86; 180/6.48, 233

[56] References Cited

U.S. PATENT DOCUMENTS

| | | | |
|---|---|---|---|
| 3,680,652 | 8/1972 | Greene | 180/243 X |
| 3,747,722 | 7/1973 | Finney | 180/247 X |
| 3,842,926 | 10/1974 | Williams et al. | 180/6.48 X |
| 3,861,535 | 1/1975 | Huxley, III et al. | 180/242 X |
| 3,901,616 | 8/1975 | Greening | 404/118 X |
| 4,655,633 | 4/1987 | Somero et al. . | |
| 4,930,935 | 6/1990 | Quenzi et al. | 404/114 X |
| 5,039,249 | 8/1991 | Hansen et al. | 404/118 X |

FOREIGN PATENT DOCUMENTS

| | | |
|---|---|---|
| 931001 | 7/1973 | Canada . |
| 1016380 | 8/1977 | Canada . |
| 1088362 | 10/1980 | Canada . |
| 1174071 | 9/1984 | Canada . |
| 1203707 | 4/1986 | Canada . |

*Primary Examiner*—Terry Lee Melius
*Assistant Examiner*—Nancy P. Connolly
*Attorney, Agent, or Firm*—Shoemaker and Mattare, Ltd.

[57] ABSTRACT

A self-propelled screeding apparatus for uncured concrete or the like includes a frame, propulsion means for the frame, a telescoping boom including at least one longitudinally slidable member and hydraulic means to move the latter with respect to the frame, and a screeding device mounted on the boom which includes a vibratory double plate providing two spaced-apart, substantially co-planar flanges for contacting material being screeded.

8 Claims, 3 Drawing Sheets

SCREEDING APPARATUS

This invention relates generally to self-propelled, mobile screeding apparatus, and the method by which it is employed.

BACKGROUND OF THIS INVENTION

The term "screeding" includes spreading, distributing, smoothing and leveling uncured concrete that has been placed or poured, but can also apply to other loose, spreadable materials such as sand and gravel. The present development relates to a vehicle which is positioned adjacent the uncured concrete, or driven through the uncured concrete, while screeding the material adjacent the vehicle without using prepositioned guides or rails.

A number of methods and techniques for spreading and leveling concrete have been developed and are part of the prior art. The simplest of these involves the passing of the edge of a two-by-four plank across the top of the poured concrete, but there are also more sophisticated power screeds. In the construction of bridges or highways, and also for large concrete floor areas like those in warehouses, large rail or guide supported screeds are typically used. These screeds employ long trusses or beams which span the width of the concrete area to be formed, and ride on heavy guides or rails adjacent opposite sides of the concrete area.

Certain prior art developments are worth noting, and the following is a list of related prior art patents.

U.S. Pat. No. 4,655,633, issued Apr. 7, 1987 to Somero et al.

Canadian patent 1,203,707, issued Apr. 29, 1986 to Allen.

Canadian patent 1,016,380, issued Aug. 30, 1977 to Fisher et al.

Canadian patent 931,001, issued Jul. 31, 1973 to McGregor.

Canadian patent 1,088,362, issued Oct. 28, 1980 to Rowe.

Canadian patent 1,174,071, issued Sep. 11, 1984 to Miller.

All of the prior developments suffer from various disadvantages and shortcomings, and it is a general object of the present invention to provide an improved, mobile, self-propelled screeding apparatus capable of reliably carrying out all of the tasks of a typical screeder, while providing increased manoeuverability and control.

In particular, this invention aims to provide an improvement over what is taught in U.S. Pat. No. 4,655,633, mentioned above. This prior patent suffers from a number of disadvantages, which it is the aim of this invention to overcome. Firstly, the prior patent (hereinafter referred to as Somero et al) provides a boom in the form of a truss, mounted in rail fashion to slide as a unit with respect to the main frame. The sliding movement is carried out by a chain drive, thus introducing a mechanical device (the chain) which is particularly subject to breaking down. Further, Somero et al drives all of his wheels from a single hydraulic motor, which means that if that motor breaks down, then the entire drive mechanism is disabled.

Another problem is that Somero et al drive the auger by a chain which connects it to a distant drive source. Again, the chain is a weak mechanical device, subject to break-downs.

Finally, Somero et al introduce an unnecessary complication by requiring the screed assembly to move along the boom, with the boom stationary and fixed in place with respect to the main frame. This requires a carriage for the screed assembly, so that it can move along the boom, thus constituting a complex mechanism that could easily break down.

By contrast, in a preferred embodiment, the present invention provides a telescoping boom which is driven by hydraulic cylinders, thus providing an extremely simplified method of moving the screed assembly toward and away from the main frame. Further, this invention provides separate hydraulic motors for each of the wheels, so that if one or more should break down, the others can still be used.

Further, in a preferred embodiment, the present invention provides an auger driven by a hydraulic motor located directly adjacent the auger. This simplifies the mechanical construction, and reduces the risk of breakdown.

Finally, in a preferred embodiment, the screed assembly in the present invention does not move along the boom, but rather is fixed with respect to a sliding member that is part of the telescoping assembly. This simplifies the apparatus.

More particularly, this invention provides a self-propelled screeding apparatus for placed and/or poured, uncured concrete or the like previously placed on the ground or another support surface, the apparatus comprising:

a frame, propulsion means on said frame for moving said frame over the ground or support surface;

a platform mounted above said frame for rotation with respect thereto, longitudinal sleeve means incorporated into said platform, a boom, the boom being a telescoping boom that includes at least one longitudinally slidable means mounted for sliding movement within said longitudinal sleeve means, and hydraulic cylinder means for causing the longitudinally slidable means to move longitudinally with respect to the longitudinal sleeve means;

screed means for spreading and/or smoothing the loose or plastic material; and screed mounting means for mounting said screed means on said boom.

GENERAL DESCRIPTION OF THE DRAWINGS

One embodiment of this invention is illustrated in the accompanying drawings in which like numerals denote like parts throughout the several views, and in which.

DETAILED DESCRIPTION OF THE DRAWINGS

Figure 1:
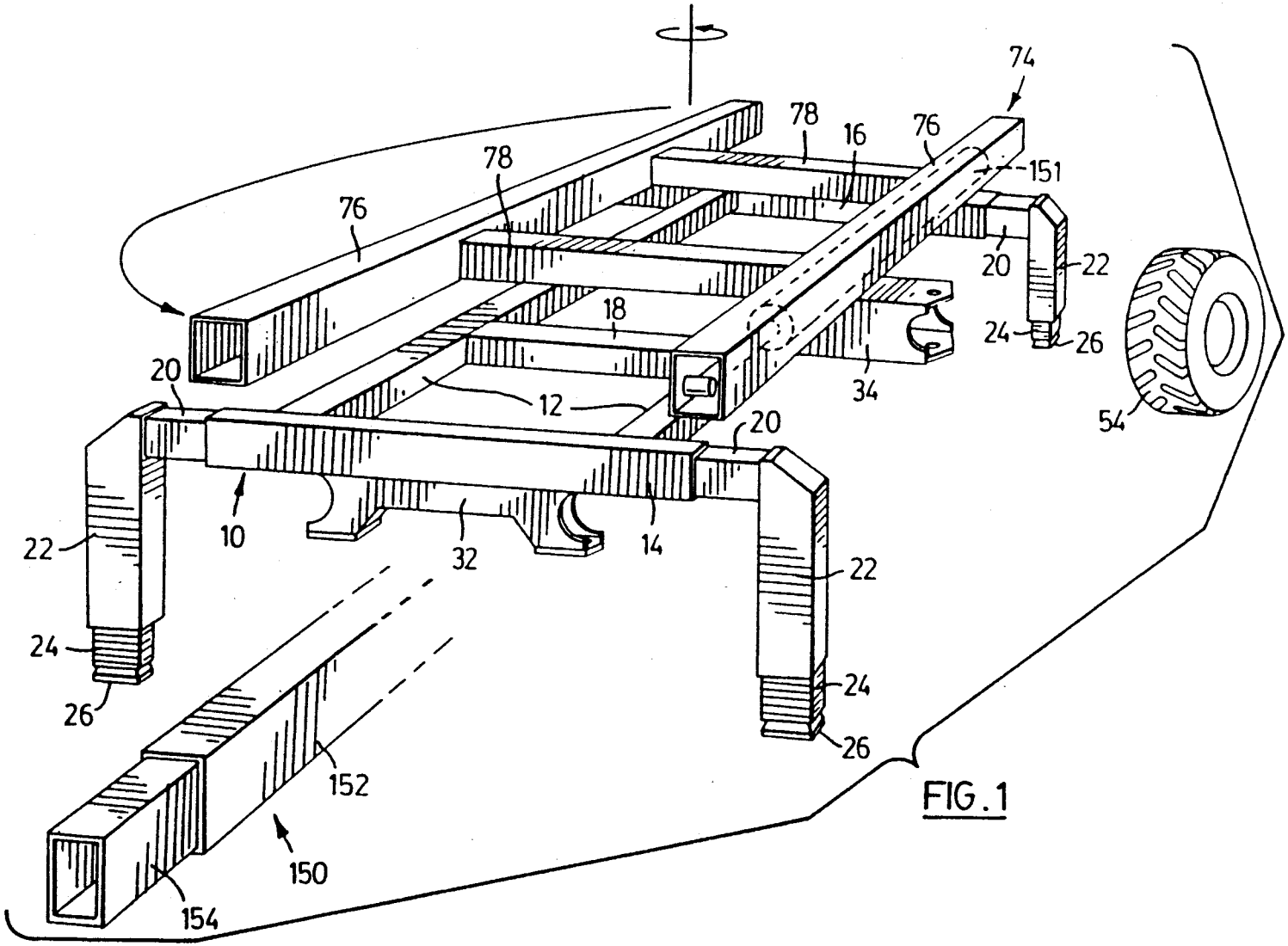
FIG. 1 is a perspective view of certain of the main components of the screeder of the present invention, showing particularly how these components relate to one another, the front end being toward the viewer.

Attention is first directed to FIG. 1, which shows a main frame 10 that includes spaced-apart longitudinal members 12 joined at the front end by a transverse member 14 which projects beyond the positions of the longitudinal members 12, and joined at the rear end by a further transverse member 16, likewise projecting outwardly beyond the positions of the longitudinal members 12. In the middle region, the longitudinal members 12 are joined by two transverse braces 18 (only one visible in FIG. 1, but both visible in FIG. 2).

In each of the end transverse members 14 and 16, which are hollow steel members of rectangular section, there are provided two sliding members 20. Each sliding member 20 has, at its outer end, a securely welded upstanding member 22, which is again of rectangular section and hollow. Each upstanding member 22 telescopingly receives a vertical sliding member 24, having a pivotal foot 26 at the bottom thereof. As shown at the bottom right in FIG. 2, each of the sliding members 20 is controlled by a hydraulic cylinder and piston 28, whereas each of the vertical sliding members 24 is controlled by a further hydraulic cylinder and piston 30. The cylinders 28 and 30 are located within the respective hollow members, and are therefore not visible in FIG. 1.

FIG. 1 shows a forward axle 32 depending beneath the longitudinal members 12 of the main frame 10, and further shows a rear axle 34, likewise situated beneath the longitudinal members 12.

Figure 2:
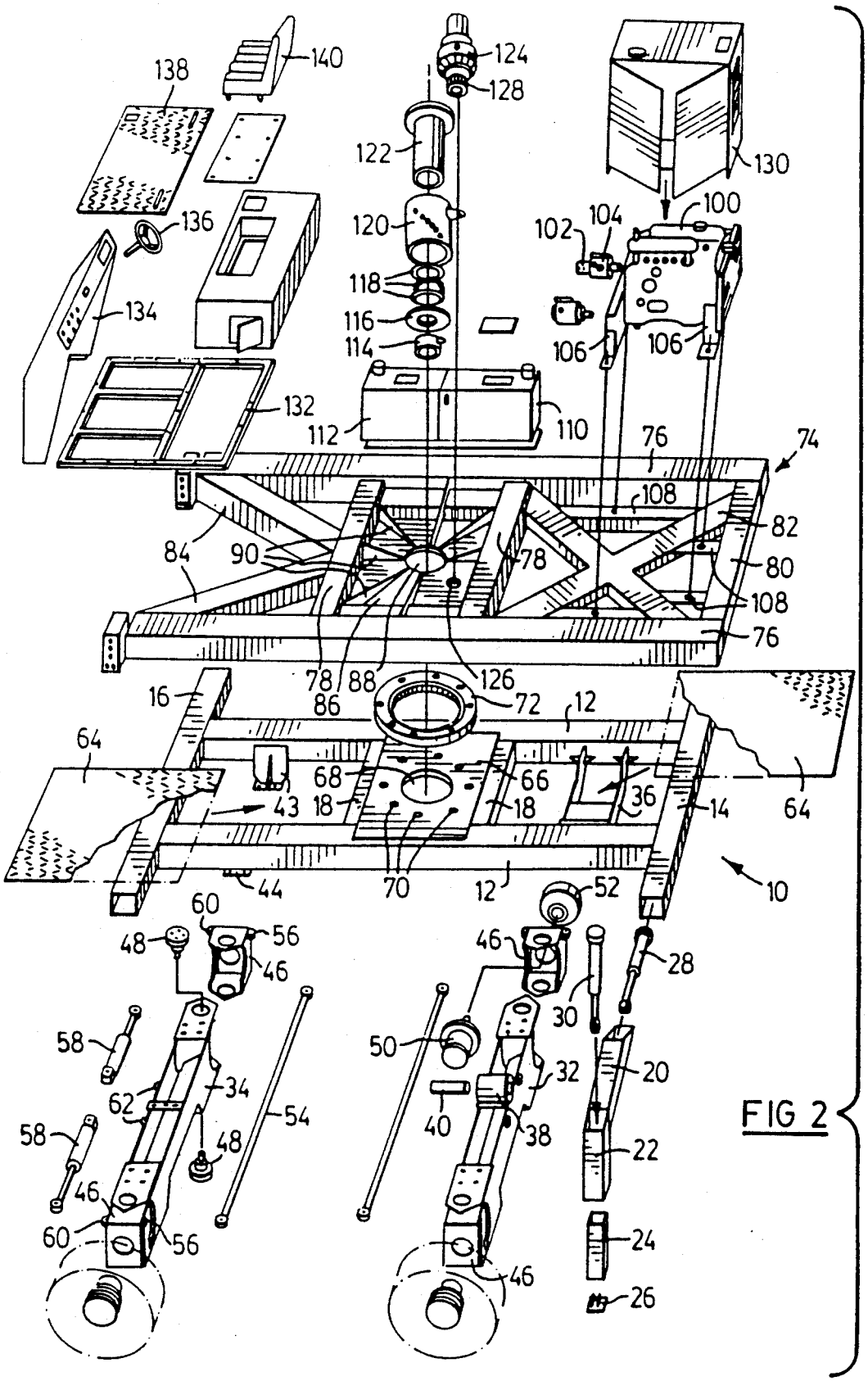
FIG. 2 is a perspective, vertically exploded view of the main components of the body of the screeder of the present invention, the front end being to the right.

As can be seen in FIG. 2, the main frame 10 includes a forward bracket 36 welded to and spanning the distance between the longitudinal members 12, the forward bracket 36 being located roughly midway between the forward transverse brace 18 and the forward transverse member 14. The forward bracket 36 has attachment means (not illustrated) which interact with a main pintle 38 located midway of the front axle 32. The pintle 38 has a central bore, in which is received a pin 40. The pin projects from either side of the pintle 38 and engages suitably located flanges (not visible) on the forward bracket 36. The front axle 32 is thus hinged to the forward bracket 36 at the pintle 38, and is allowed to swing through a limited arc about a front-to-rear axis. Thus, the front axle 32 swings in a vertical plane which is perpendicular to the longitudinal members 12.

Again looking at FIG. 2, the main frame 10 includes two separate downwardly projecting flanges 43 and 44, secured respectively to the two longitudinal members 12, and located roughly midway between the rear transverse brace 18 and the rear transverse member 16. These flanges 43 and 44 are designed and positioned so as to allow the rear axle 34 to be securely bolted to the main frame 10.

The two axles 32 and 34 are each designed to support two wheels and to this end they are provided with swivel brackets 46. As can be seen in FIG. 2, each swivel bracket 46 is designed to be connected to its respective end of the axle in such a way that it can swivel through a limited arc about a vertical axis defined by a kingpin 48. In FIG. 2, the remote swivel brackets 46 are shown in exploded relation away from the respective axle, whereas at the near end in FIG. 2 the swivel brackets are connected to their respective axles. Each axle is designed to support and surround a hydraulic motor 50 which, through the intermediary of a planetary wheel drive device 52, is adapted to rotate a wheel. No wheels are shown in FIG. 2, but a single wheel 54 is illustrated in FIG. 1, in exploded relation away from its respective end of the rear axle 34. It is to be understood that four wheels would be provided.

The four swivel brackets 46 allow independent steering of either end of the vehicle. Specifically, the swivel brackets 46 at either end of the rear axle 34 are adapted to rotate together in the same sense (thus maintaining alignment of the wheels at the rear), and this is ensured by the provision of a tie rod 54 which is connected between corresponding flanges 56 projecting from the swivel brackets 46.

In order to provide the force necessary to swivel the two wheels at the rear end (left in FIG. 2), there are provided two hydraulic cylinders 58, functioning as steering cylinders. Each steering cylinder 58 is connected between a flange 60 on the respective swivel bracket 46, and a flange 62 permanently connected to the rear axle 34.

Precisely the same arrangement occurs at the front axle 32, and the various parts do not need to be described again.

As seen in FIG. 2, two metal plates 64 are adapted to be welded between the longitudinal members 12 at the forward and rearward regions. More specifically, one of the plates 64 spans between the forward transverse member 14 and the forward transverse brace 18, while the other spans between the rearward transverse brace 18 and the rearward transverse member 16.

A central plate 66 is also provided, and is welded to the main frame between the transverse braces 18. As can be seen, the plate 66 has a central opening 68 and a plurality of bores 70 which allow the bolting of a slewing ring 72.

Attention is again returned to FIG. 1, which shows, located above the main frame 10, a rotatable platform 74, this being only partly shown in FIG. 1, in order to allow the viewer to see past the platform 74 to the structure beneath. In FIG. 1, the rotatable platform 74 is seen to include two longitudinal members 76 connected together by transverse braces 78. In FIG. 2, it can be seen that the rotatable platform 74 also includes a forward transverse member 80, a cross-bracing 82, and angular bracing 84. Further, the rotatable platform 74 includes a reinforced steel plate 86 welded under the four members 78 and 76, and having a central opening 88 adapted for axial alignment with the opening 68 in the slewing ring 72. Triangular braces 90 for the plate 86 are visible in FIG. 2.

At the top in FIG. 2 are shown, in exploded relation, various components for operating and controlling the apparatus. These include an engine 100 which drives a gear pump 102 and a piston pump 104. Brackets 106 allow the engine 100 to be securely fastened to braces 108 at the forward end of the rotatable platform 74. A hydraulic oil tank is shown at 110, whereas a fuel tank for the engine 100 is shown at 112.

Illustrated in exploded relation above the fuel tank 112 are an electric collector ring 114, a centre post back cover 116, a thrust bearing 118, a centre post manifold 120, and a centre post 122. Above the centre post 122 is illustrated a swing reduction unit 124, which passes through an eccentric opening 126 in the plate 86, and engages the slewing ring 72 with the pinion 128. Rotation of the pinion 128 causes the plate, and thus the entire rotatable platform 74, to rotate with respect to the main frame, due to the fact that slewing ring 72 is fixed with respect to the main frame 10.

Illustrated above the engine 100 is an engine protection cover 130.

At the upper left in FIG. 2 is shown a cab frame 132 adapted to be bolted midway of the rotatable platform 74, and to support a control panel 134 which has a steering wheel 136 and various gages. A plate 138 provides the floor of the cab, and a seat 140 for the driver is also provided.

Figure 3:
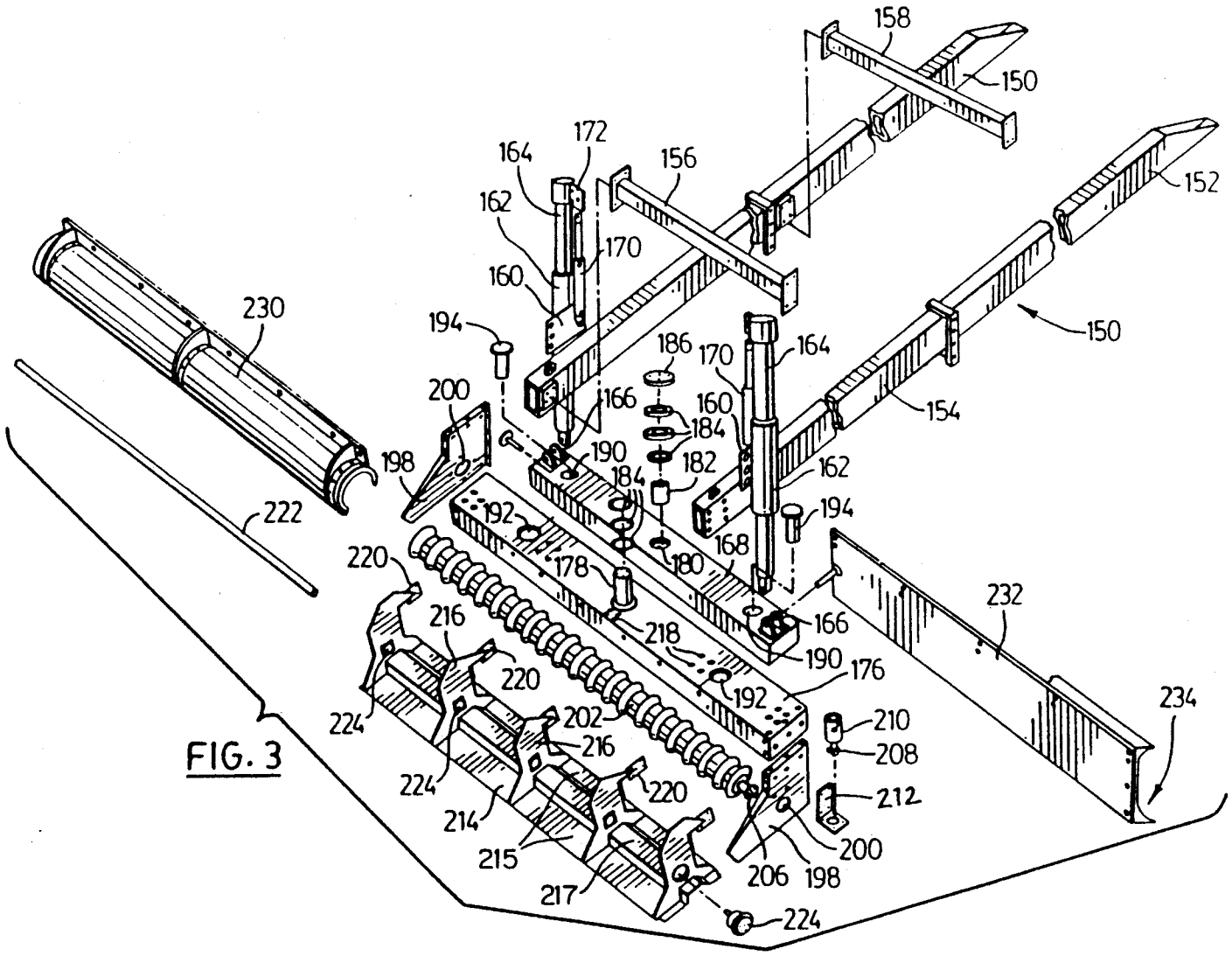
FIG. 3 is an exploded perspective view of the screeding end of the screeder of the present invention, again showing how the various portions are related to each other.

Attention is now directed to FIGS. 1 and 3, from which it will be clear that each of the longitudinal members 76 slidingly encloses a two-part telescoping boom 150 (only one of these being illustrated in FIG. 1). Associated with the longitudinal members 76 and the respective telescoping booms 150 are hydraulic cylinders (one shown in broken lines at 151) which accomplish the respective movement of each telescoping boom 150 with respect to the corresponding longitudinal member 76.

Looking now at FIG. 3, it will be seen that each telescoping boom 150 incorporates an intermediate member 152 and an inner member 154. It is to be understood that the telescoping boom could consist of three members or two members. For example, in FIG. 1, the intermediate member 152 could be eliminated, leaving the inner member 154 to slide longitudinally within the longitudinal member 76 forming part of the rotatable platform 74.

Returning to the embodiment as illustrated in FIG. 1, the forward ends of the inner members 154 are secured together by a transverse brace 156, whereas the forward ends of the outer members 152 are joined together by a further transverse brace 158.

Secured against the forward outside surface of each inner member 154 is a bracket 160 which supports an upright sleeve 162 through which slidably passes a levelling mast 164. As can be seen in FIG. 3, the lower end of each mast 164 is secured between brackets 166 at either end of a vibratory screed main support 168. The vertical position of each levelling mast 164 is adjusted by appropriate levelling cylinders 170 secured between the respective plate 160 and an upper bracket 172 secured to the respective mast 164.

The numeral 176 designates a vibratory screed swivel support in the form of a transverse elongated member having a central upstanding post 178 adapted to pass through an opening 180 in the main support 168. A bronze bushing 182 surrounds the post 178 within the bore 180, and thrust bearings 184 are also provided for the mounting. A pivot pin flange 186 is adapted to be bolted onto the top of the post 178 when the latter is in its position after passing through the opening 180.

The main support 168 has further openings 190 adapted to be aligned with recess 192 in the swivel support 176, and screed locking pins 194 are adapted to pass through the aligned openings 190 and recesses 192, thus retaining the swivel support in approximate alignment with the transversely located main support 168.

Depending downwardly from either end of the swivel support 176 are end plates 198 which are adapted to be secured to the swivel support 176, and which have openings 200 for receiving stub shafts projecting from either end of an auger 202.

As can be seen, the rightward end of the auger 202 supports a bevel gear 206, which projects through the rightward opening 200 and engages a bevel gear 208 rotated by a hydraulic motor 210 which is supported on a bracket 212 secured to the end plate 200.

The numeral 214 designates a vibratory double plate having brackets 216 adapted to be bolted against the swivel support 176, using for that purpose apertures 218 and apertured plates 220 which are secured to the various brackets 216.

The vibratory double plate 214 includes two substantially co-planar flanges 215 extending oppositely from an inverted channel portion 217 with which they are, in the illustrated embodiment, integral.

A vibratory plate shaft 222 extends through suitable openings 223 in the vibratory double plate 214, and is adapted to be rotated by a vibratory plate hydraulic motor 224 which is mounted to the rightward end of the vibratory double plate 214.

An auger cover 230 is also provided.

Located against the rearward side of the swivel support 176 is a screed plate 232 with a convex rearward configuration as seen at 234.

Those skilled in this art will readily understand how the various hydraulic motors and hydraulic cylinders can be controlled from the central cab by the operator in order to determine the angular orientation of the rotatable platform with respect to the main frame, the position of the screeding apparatus with respect to the main frame, the vertical level of the screeding apparatus with respect to the telescopic booms 150, and the actual operation of the screeding apparatus. It will also be appreciated that the manoeuverability of this device is greatly enhanced by the fact that each wheel is separately mounted for rotation, and separately turned by an individual hydraulic motor.

The outriggers shown in FIG. 1 (the upstanding members 22) and the outrigger legs 24 allow the apparatus to be firmly anchored with respect to an existing base surface, lifting the wheels 54 off the ground by the downward extension of the legs 24.

While one embodiment of this invention has been illustrated in the accompanying drawings and described hereinabove, it will be evident to those skilled in the art that changes and modifications may be made therein without departing from the essence of this invention.

The embodiments of the invention in which an exclusive property or privilege is claimed are defined as follows:

1. A self-propelled screeding apparatus for placed and/or poured, uncured concrete or the like previously placed on the ground or another support surface, the apparatus comprising:

a frame, propulsion mans on said frame for moving said frame over the ground or support surface;

a platform mounted above said frame for rotation with respect thereto, longitudinal sleeve means incorporated into said platform, a boom, the boom being a telescoping boom that includes at least one longitudinally slidable means mounted for sliding movement within said longitudinal sleeve means, and hydraulic cylinder means for causing the longitudinally slidable means to move longitudinally with respect to the longitudinal sleeve means;

screed means for spreading and/or smoothing the loose or plastic material;

a vibratory double plate forming part of said screed means, the double plate including two spaced-apart, parallel flanges, and means for vibrating the plate; and screed mounting means for mounting said screed means on said boom.

2. The apparatus claimed in claim 1, in which said propulsion means includes four wheels, each of which is driven by its own separate hydraulic motor mounted adjacent to the respective wheel.

3. The apparatus claimed in claim 1, in which the screed means includes a horizontally disposed auger and a hydraulic motor adapted to rotate said auger, said last-mentioned hydraulic motor being mounted adjacent to the auger.

4. The apparatus claimed in claim 1, in which said screed means is fixedly mounted to, and moves with, the end of the longitudinally slidable means which is remote from the platform.

5. The apparatus claimed in claim 2, in which the screed means includes a horizontally disposed auger and a hydraulic motor adapted to rotate said auger, said last-mentioned hydraulic motor being mounted adjacent to the auger.

6. The apparatus claimed in claim 2, in which said screed means is fixedly mounted to, and moves with, the end of the longitudinally slidable means which is remote from the platform.

7. The apparatus claimed in claim 5, in which said screed means is fixedly mounted to, and moves with, the end of the longitudinally slidable means which is remote from the platform.

8. The apparatus claimed in claim 1, in which the two flanges are integral with, and extend oppositely from, a central inverted channel portion.

* * * * *